US008109280B2

(12) United States Patent
Winckels et al.

(10) Patent No.: US 8,109,280 B2
(45) Date of Patent: Feb. 7, 2012

(54) COSMETIC PRODUCT COMPACT HAVING PIVOTING SECTIONS

(75) Inventors: Mathilde Winckels, Asnieres-sur-Seine (FR); David Prague, Ringoes, NJ (US)

(73) Assignee: L'Oreal, Paris (FR)

( * ) Notice: Subject to any disclaimer, the term of this patent is extended or adjusted under 35 U.S.C. 154(b) by 509 days.

(21) Appl. No.: 11/609,818

(22) Filed: Mar. 19, 2008

(65) Prior Publication Data

US 2009/0308408 A1 Dec. 17, 2009

(51) Int. Cl.
*A45D 33/22* (2006.01)
*A45D 33/26* (2006.01)

(52) U.S. Cl. ..... 132/295; 132/294

(58) Field of Classification Search ..... 132/293–295, 132/300, 305; 206/581, 823
See application file for complete search history.

(56) References Cited

U.S. PATENT DOCUMENTS

| | | | | |
|---|---|---|---|---|
| 1,460,950 A | | 7/1923 | Denney | |
| 3,161,315 A | | 12/1964 | Braun | |
| 3,188,157 A | | 6/1965 | Rand | |
| 3,392,868 A | | 7/1968 | Pfrommer | |
| 3,441,033 A | * | 4/1969 | Flax | 132/295 |
| 3,476,123 A | | 11/1969 | Flax | |
| 4,560,078 A | | 12/1985 | Dubuisson | |
| 4,807,773 A | * | 2/1989 | Tsai | 220/4.27 |
| 5,632,394 A | * | 5/1997 | Mecca et al. | 220/824 |
| 5,709,232 A | * | 1/1998 | Sheffler et al. | 132/295 |
| 5,836,319 A | | 11/1998 | Lombardi | |
| 6,186,349 B1 | | 2/2001 | Tempongko | |
| 6,378,533 B1 | * | 4/2002 | Roman | 132/295 |
| 6,526,989 B2 | * | 3/2003 | Sheffler et al. | 132/294 |
| 6,619,297 B2 | | 9/2003 | Sheng | |
| 6,712,076 B2 | * | 3/2004 | Alexander et al. | 132/300 |
| 7,614,405 B2 | * | 11/2009 | Allen et al. | 132/295 |

FOREIGN PATENT DOCUMENTS

| | | |
|---|---|---|
| FR | 2-737-091 | 1/1997 |
| GB | 1212209 | 11/1970 |
| JP | 60-002909 | 1/1985 |
| JP | 2000-83724 | 3/2000 |
| WO | 2004-002846 A1 | 1/2004 |

* cited by examiner

*Primary Examiner* — Robyn Doan
(74) *Attorney, Agent, or Firm* — Oblon, Spivak, McClelland, Maier & Neustadt, L.L.P.

(57) ABSTRACT

A device such as a compact or product container includes a plurality of stacked sections or housings, which are pivotable with respect to each other. The sections are substantially aligned with each other when the device is in a closed position, and when pivoted with respect to each other, the device is opened to allow access to compartments or reservoirs of the different sections. According to an example, a lower housing or section can include a projection which is received in a groove formed in the adjacent section and a depth of the groove can change from a first end of the groove to a second end of the groove to thereby change and vary the resistance felt by the user.

59 Claims, 3 Drawing Sheets

COSMETIC PRODUCT COMPACT HAVING PIVOTING SECTIONS

FIELD OF THE INVENTION

This invention relates to a container for holding a cosmetic product. According to an example, the container has sections that are configured to pivot with respect to each other in a controlled manner and lock in the opened and closed positions.

DESCRIPTION OF THE RELATED ART

Storage containers for cosmetics or the like, are known that have one or more storage parts for holding cosmetic products with the storage parts formed as pivoting sections that pivot about a centrally located axis. For example, U.S. Pat. No. 4,560,078 discloses a rotary telescopic tray structure including six trays stacked on a common central post. Each tray except the bottom tray has a catch on its undersurface adjacent a peripheral corner of the tray. As the upper tray is rotated, the trays will fan out into the extended position with a preceding tray pulling out the succeeding tray below it when the respective catches engage one another.

However, with the above discussed device, there is no arrangement to control the rotational torque. This device merely provides a catch to stop the complete rotation of the tray in the opened or closed position.

Therefore, cosmetic compacts in the related art do not provide for a feature to sufficiently control the feel of the pivoting movement between the open and closed positions of the sections and thus, may leave the user with a feeling that the compact device is of poor quality and/or is not structurally adequate to prevent the cosmetic product from spilling out of the container from inadvertent opening.

Additionally, pivoting mechanisms similar to the central post discussed above in U.S. Pat. No. 4,560,078, include an opening and closing mechanism that can require a lot of space. Further, the related art includes pivoting sections connected by a complex securing device as disclosed in FR2737091. As shown in JP60-2909, the related art also includes latching devices that will be highly visible to the user, which also may not be desirable.

SUMMARY OF THE INVENTION

According to an aspect of the invention, it has been recognized that prior compact devices suffer from one or more disadvantages including: less than satisfactory pivoting action or pivot mechanisms, poor security of feel to the user, and/or an opening or pivoting mount that is cumbersome or unsightly.

The present invention relates to improved container and/or compact devices. According to an example, the device includes a container that is suitable for packaging of a product with sections pivotable with respect to each other that allow a user to open the sections of the compact device in a secure manner. For example, an upper section can be rotated with respect to a lower base section.

According to an example, the cosmetic device has a rotating torque that provides a desirable resistance to the user when rotating and provides confidence to a user that the pivoting sections are secured in the open or closed position and during rotation.

In one example, one of the sections of the compact device includes a projection that is received in a groove formed in another section to provide a secure and controlled swiveling of the sections with respect to each other. That is, the projection and corresponding groove are configured such that mechanical resistance developed by the projection within the groove changes when the projection is moved from a first end to a second end of the groove. With such an arrangement, the projection sliding in the groove can provide a secure non-loose feeling to the user during opening and closing of the pivoting sections. According to a further improvement, the depth and/or width of the groove changes in order to increase or decrease the amount of contact between the projection and groove. In this way, resistance generated between the projection and the groove changes and alters the feeling to the user during opening and closing.

In another example, in the opened and closed positions, the groove includes a deeper portion to allow the projection to be at least partially inserted therein to prevent further rotation of the sections with respect to each other.

In an alternative embodiment, the groove begins at a first position substantially adjacent a side wall of section and extends in an arcurate shape to a second position substantially adjacent the side wall. Another example provides the groove over only part of a distance between the first and second positions.

Embodiments of the present invention can include, for example, a pivoting device forming an axis of rotation that is at least substantially non-visible by the user. As an example, the pivoting device, such as a pin, can be formed in an interior portion, for example in the side wall, of the one or more sections. Accordingly, it is difficult for a user to see any portion of the pivoting device, which provides an aesthetically pleasing cosmetic container.

An example of the invention provides the projection and groove features separate from the pivoting feature, which allows for a smaller wall thickness in the plurality of sections of the cosmetic container.

By way of example, a latching device can be provided for connecting a cover or lid to a section in the closed position to allow for a positive and stable or secure feel to the user when the lid opens or closes.

An example of the invention includes a device to provide an audible click to indicate a section has arrived at the open and/or closed position with respect to an adjacent section.

The device according to the invention may advantageously be used for packaging or a cosmetic or dermatological product, in the form of a liquid, soft, semi-soft, or hard product.

As should be apparent, the invention can provide a number of advantageous features and benefits. It is to be understood that in practicing the invention, an embodiment can be constructed to include one or more features or benefits of embodiments disclosed herein, but not others. Accordingly, it is to be understood that the preferred embodiments discussed herein are provided as examples and are not be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as non-limiting examples of the invention. In the drawings.

DETAILED DESCRIPTION OF THE PREFERRED EMBODIMENTS

Figure 1:
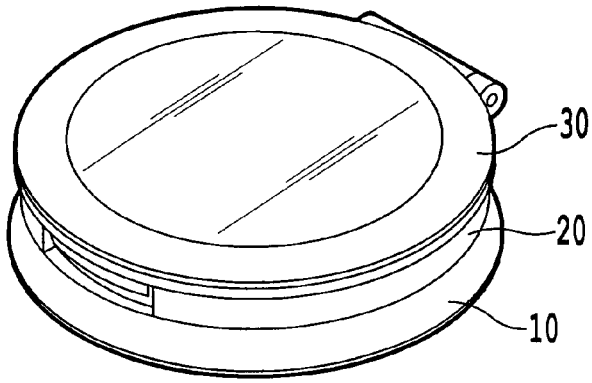
FIG. 1 is a schematic showing a compact device according to an example of the invention.

Reference will now be made in detail to the present preferred embodiments of the invention, examples of which are illustrated in the accompanying drawings. Wherever possible, the same reference characters will be used throughout the drawings to refer to the same or like parts.

As discussed earlier, during use of a compact, an opening and closing that is not controlled can feel loose and insecure to the user. Additionally, a pivoting mechanism that takes up a lot of space and is visible to the consumer is not desirable.

Accordingly, the compact device preferably includes pivoting portions that open and close in a secure manner and lock in the opened and closed positions. Further, the pivoting portion of the compact device is not visible to the user during normal use which provides an aesthetically pleasing device to the user.

Figure 2:
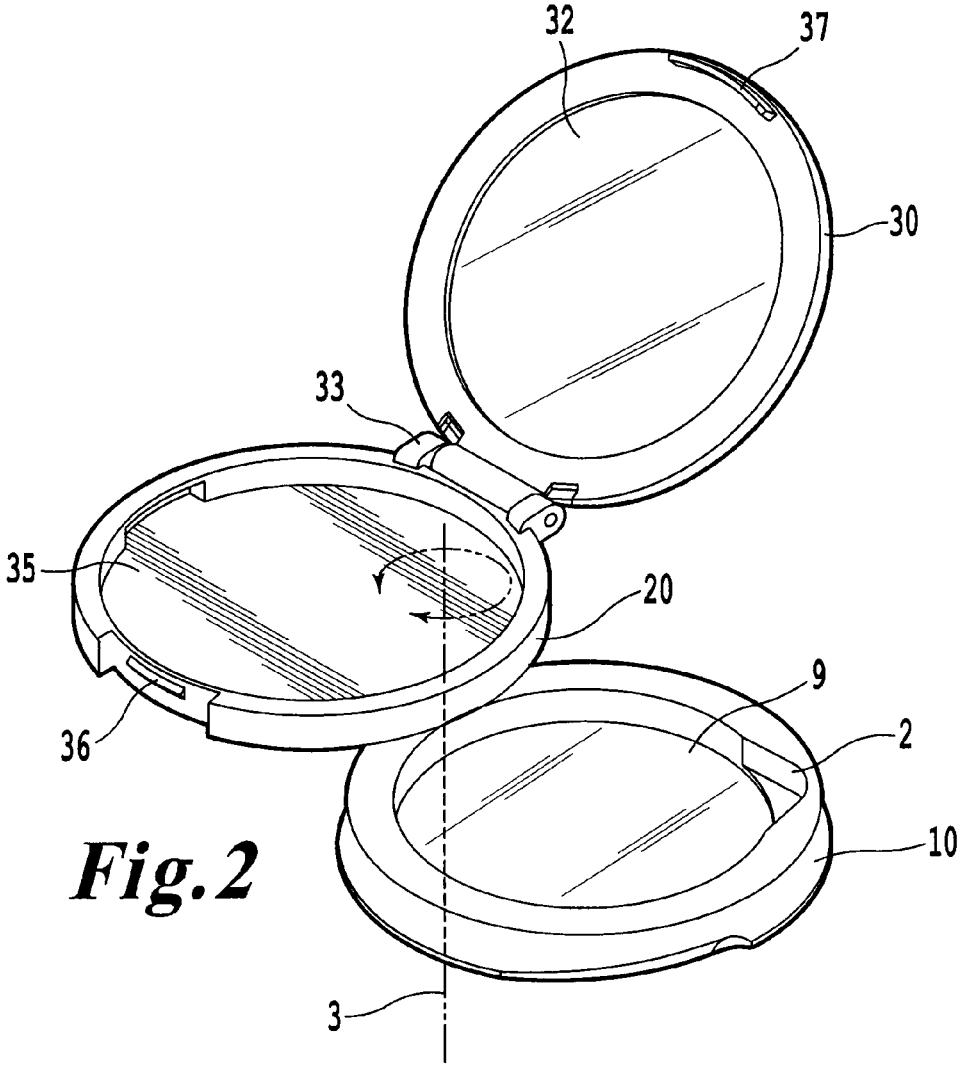
FIG. 2 is a schematic showing swiveling/pivoting sections according to an example of the invention.

FIGS. 1 and 2 are schematics showing the compact device according to one or more examples of the invention. The compact device can be a generally circular device that includes a base 10, center pivoting section 20, and a cover 30. The compact device is shown having the base 10 and center section 20 that pivot horizontally with respect to each other. In other words, during pivoting, relative movement of the sections is horizontal. In this example, the pivoting movement is about an axis 3 perpendicular to the base and center sections, for example, with the pivot axis perpendicular to the bottom of the base.

It is within the spirit and scope of the invention to have any number of sections that can pivot with respect to each other. For example, a base 10 can be provided along with two sections 20, and a cover 30. The base 10 and sections 20 would be able to rotate with respect to each other in a similar manner as described in one or more examples set forth below. Where additional pivotable sections are provided, they can pivot about a common axis or plural coaxial axes, or alternatively, they can pivot about axes that are at different locations about the periphery of the compact. For example, with two center sections, one center section can pivot with respect to the other center section at a location diametrically opposite to the pivot between one section and the base, or the pivot axes can all be aligned.

The compact device is shown in the Figures as a generally circular device. However, examples of the invention can include a compact device having any desirable shape such as triangular, oval, square, rectangular, and the like. Further, it should be appreciated that the compact device of the invention can be made of any known or later developed material such as plastic or metal, which can be formed into a structure capable of containing a cosmetic product for a user.

Figure 6:
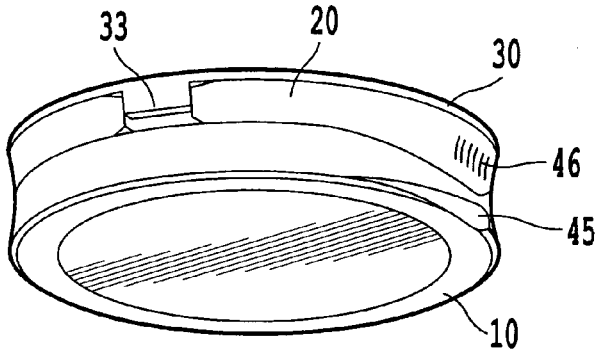
FIG. 6 is a side view of a partially opened compact device according to an example of the invention.

An example of the invention provides for at least a part of the outside side wall of one or more of the base 10, center section 20, and cover 30 to be tapered to form a gripping area for the user to place their hands when holding the compact. The tapered region can provide a secure feeling to the user that the compact will not slip out of their hands. As an example, the outer surface 4, best shown in FIG. 3B, of the side wall of the base 10 is tapered, for example, inwardly to the surface adjacent the bottom surface of the center section 20. Further, the outer surface 14, best shown in FIG. 3A, of the center section 20 is tapered, for example, outwardly from the surface adjacent the base 10 to a contact area with the cover 30. The cover 30 can also be tapered, if desired, in any fashion to form the upper part of the tapered gripping area. For example, the widest diameter area of the compact device can be formed at the bottom of base 10 and at the top portion of cover 30, with the narrowest diameter formed at the contacting area between the base 10 and center section 20. Thus, for example, as shown in FIG. 6, the top (or cover) 30 and bottom (or base) 10 can have a larger diameter or periphery than the center of the compact.

Accordingly, it should be appreciated that due to design, aesthetic and/or other considerations, the side surfaces of the base 10, center 20, and/or cover 30 can have the same or different diameters, be any shape, such as curved and/or can be formed with protrusions or the like to provide the user with a secure grip on the compact device during use. Further by way of example, protrusions can also be formed on only a part of the side surfaces of the base 10, center 20, and/or cover 30 to provide a gripping area to aid with opening and closing of the compact device.

By way of example, the base 10 and center section 20 can be generally hollow structures with side walls and a bottom portion as illustrated in the drawings. When in the closed position as shown in FIG. 1, the top of the base 10 can be closed by the bottom of the center section 20 and the top of the center section 20 can be closed by the cover 30. The hollow interior portions of the sections are configured to hold cosmetic products, mirrors, cosmetic pads, and the like, as discussed below.

According to a preferred embodiment of the invention, as best shown in FIG. 2, the hollow interior portion of the center section 20 is a reservoir or containing area 35 for the product to be stored. The product can be for example, a lip, a skin, or other type of make-up or dermatological product and can be in the form of, for example, a liquid, a gel, a cream, powder and can have the consistency of, for example, a solid or cake, pasty, semi-soft, or flowable product. The base 10 can include a mirror 9 for use by the consumer during application of the product. The cover 30 includes a transparent area 32 to allow the user to see through the cover 30 at the product contained therein to eliminate the need to open the compact to determine what is inside.

The hollow interior portions of the base 10 and/or center section 20 can also be used to store an applicator pad or dispenser used in applying the cosmetic product stored in the compact device. For example, an indentation 2 can be formed to help the user to gain access to the mirror, contents, and/or applicator. The indentation 2 can be formed in any of the pivotal sections. Additionally, the interior portions of either the base 10 or center 20 can have a mirror formed therein for use by the consumer during application of the cosmetic product. Therefore, it should be appreciated that either the base 10 or center section 20 can contain a product, an applicator pad, and/or a mirror.

As discussed above, FIG. 2 shows a base 10 and center section 20 pivoting with respect to each other. However, it is within the spirit and scope of the present invention to have multiple sections that pivot with respect to each other utilizing the features of embodiments of the invention described herein. Accordingly, one of the one or more pivoting sections could have any one of a mirror 9, a cosmetic product, and/or applicator, and the like contained therein as desired by the user. More than one component can also be provided in a given compartment. For example, a compartment could hold a mirror and an applicator (such as an applicator pad), or a compartment can include a product and an applicator.

The cover 30 is configured to be pivotally connected to the top portion of the center section 20 and opened and closed by the user to allow the user access to the interior of the center section 20. The cover can be rotated sufficiently, for example at least 90 degrees, to allow the user access to center section 20. The cover can be a solid one piece or can include one or more transparent areas to allow the user to look inside section 20. The center section 20 is connected to the cover by way of a connecting device 33, such as for example a pin or similar type structure as shown in FIGS. 1 and 2. According to an example shown in FIG. 6, the connection device and also an area around the connection device, between the cover 30 and center section 20 can be recessed into a portion of, for example, the side walls of the cover 30 and/or center section 20 to maintain the smooth exterior surface for the user to grip when holding the compact device.

When the cover 30 is closed, the center section 20 and cover 30 are connected together in a secured manner to prevent the cosmetic product from escaping from the center section 20. As an example, a ridge 36 is formed with the center section 20 that can contact a protrusion 37 formed on cover 30 to secure the cover 30 to the center section 20. It should be appreciated that the ridge 36 and protrusion 37 can have any desirable shape or size and the connecting device between the cover 30 and center section 20 can be in the form of a clasp or snap or similar structure in order to facilitate the connection there between. Further, the connecting device can be formed to make an audible sound when connected together to alert the user that a secure connection was made.

FIG. 2 shows the compact device with the cover 30 open and the center section 20 and base 10 pivoted with respect to each other. According to the example shown in FIGS. 1 and 2, the center section 20 rotates with respect to the base, approximately 180 degrees from the closed position to the open position. As also shown in FIG. 2, according to a preferred example, the axis rotation or pivot axis of the lid with respect to the center section extends transverse to the axis of rotation or pivot axis 3 of the center section with respect to the base. In the illustrated example, the lid pivots relative to the center section about an axis perpendicular to the pivot axis of the center section relative to the base. Rotating the two sections this amount allows the user to have maximum access to the hollow interior portion of base 10. After rotating 180 degrees, the center section 20 and base 10 can be locked into that position by a locking device discussed in more detail with respect to FIGS. 3A, 3B and 4. The locking device will preferably engage at the open angle resulting in the center section 20 being stably secured and locked in the desired position with respect to the base 10. It should be appreciated that the center section 20 and base 10 can rotate any desirable amount before being locked into position, for example at an angle less than or greater than 180 degrees.

As shown in FIG. 2, a part of the bottom surface of the center section 20 can contact and/or overlap a portion of the base 10, depending on the depth of the side wall of the base 10, when the two sections are at a desirable rotation with respect to each other. In this way, the base section 10 and center section 20 can provide support in the open position. It should be appreciated that any various amounts of the base 10 can remain in contact and/or be overlapped by the center section 20 in the open position depending on the amount of full rotation provided. Preferably, the entire recess is accessible in the open position. For example, as shown in FIG. 2, an outer surface of the side wall of the center section 20 to be substantially on a same plane as an interior surface of the side wall of base 10. This will allow the user to have full access to the interior of the base 10 without interference from a portion of, for example the side wall of, the center section 20. As an example, with a mirror 9 formed in the base 10, the mirror 9 is in full view to the consumer while using a cosmetic product 35 contained in the center section 20. Alternatively, if a product is provided in the lower section, the user can preferably have access to the entire product. For certain configurations, it may not be necessary to have the entire recess open and accessible. For example, where the bottom section is used to contain an applicator, opening an amount sufficient to allow the applicator to be retrieved need not require complete opening or complete exposure of the recess.

Figure 3A:
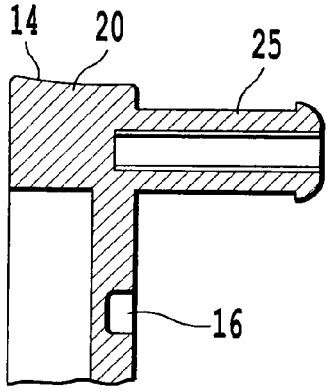
FIG. 3A is a cross-section of a section of the compact device showing a receiving portion for a pin according to an example of the invention.
Figure 3B:
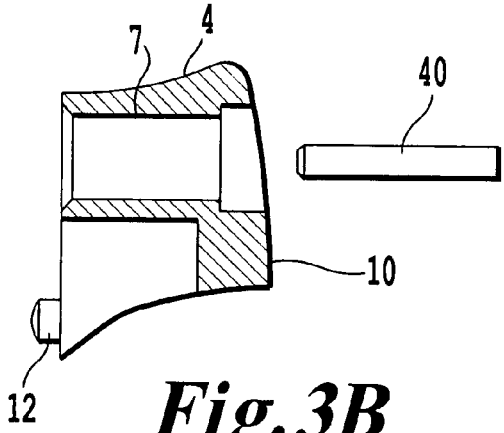
FIG. 3B is a schematic showing the pin and the pin receptor of a section of the compact device according to an example of the invention.

FIGS. 3A and 3B are cross sectional views of portions of the center section 20 and base portion 10, respectively and a connection device that provides a secure connection between sections and allows for rotation of sections with respect to each other. By way of example, the center section 20 can include a pin receiving portion 25. The pin receiving portion 25 is formed as generally a tubular section for receiving the pin 40. It should be appreciated that the opening or recess of the pin receiving portion 25 can be any shape or size as long as it is able to receive the pin 40 of similar size and shape. The receiving portion 25 can include flange portions formed at one end that can contact edges formed in the aperture 7.

When the base 10 and center section 20 are secured together, the pin receiving portion 25 of the center section 20 is engaged with the aperture 7 formed in the base 10. For example, the receiving portion 25 is slid into the aperture 7 and then the pin 40 is inserted into the receiving portion 25. When the pin 40 is inserted into the pin receiving portion 25, the pin 40 forces walls of the receiving portion 25 to expand outwardly. By expanding the receiving portion 25 in this way, a controlled resistance is created due to the contact between the wall of the receiving portion 25 and the inner wall of the aperture 7. Further, since the pin 40 is inserted therein, walls of the receiving portion 25 are prevented from collapsing inwardly and a secure connection between the base 10 and center section 20 is created. A further example of the invention provides a receiving portion 25 that is formed as a solid one-piece device that can be inserted into the aperture 7. In accordance with the examples discussed above, a pivot axis 3 is therefore formed between the base section 10 and center section 20 that allows the two sections to rotate with respect to each other. As discussed previously, any number of pivotable sections can be formed on top of one another. Therefore, a connection device similar to the one discussed above can be formed in any number of adjacent sections to allow for pivoting movement between the sections.

As shown in FIGS. 3A and 3B, the various features of the connection device are small enough to be contained within the confines of the side walls of the base 10 and center section 20. Securing adjacent sections together with such a connection device allows the base 10 and center section 20 to pivot with respect to each other as discussed and shown in FIG. 2. In this way, design, aesthetic and/or other considerations can be taken into account that are desirable to the user.

By way of example, one or more sections of the compact device can include a projection that is received in a groove formed in another section to provide a secure and controlled swiveling of the sections with respect to each other. The projection and corresponding groove are configured such that mechanical resistance developed by the projection within the groove changes when the projection is moved from a first end to a second end of the groove. In this way, resistance generated between the projection and the groove alters the feeling to the user during opening and closing. As such, the projection sliding in the groove can provide a secure non-loose feeling to the user during opening and closing of the pivoting sections.

Figure 4A:
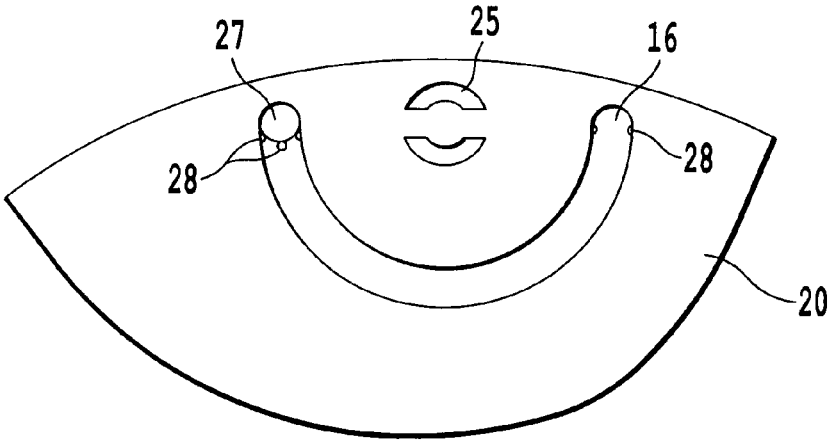
FIG. 4A is a schematic showing the bottom of a section having a groove formed therein according to an example of the invention.

As an example, as shown in FIGS. 3A, 3B, 4A, and 4B a projection 12 can be formed on the base 10 with a projection receiving portion 16 formed on the center section 20. For example, the projection receiving portion 16 can be in the form of a groove located on a bottom surface of the center section 20. When the base 10 and center section 20 are pivoted with respect to each other about the pin 40, the projection 12 is configured to slide within the groove 16. It should be appreciated that the groove 16 can be any depth or shape to allow the groove 16 to receive the projection 12 formed on the swivel base 10. As shown in FIG. 4A, the groove 16 can be curved to be in the shape of, for example, a semicircle or arc that allows for example a 180 degree rotation of the center section 20 with respect to the base 10.

As an example, when the base 10 and center section 20 are closed as shown in FIG. 1, the projection 12 will be located at one end of the semicircular groove 16 shown in FIG. 4A. When the base 10 and center section 20 are rotated open, the projection 12 slides in the groove 16 during rotation and will end up at the other end of the semicircular groove 16 when the base 10 and center section 20 are at complete rotation, as shown in FIG. 2. As such, the center section 20 rotationally slides horizontally relative to base 10 with a suitable resistance feel.

Figure 4B:
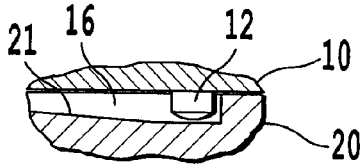
FIG. 4B is an inverted cross-sectional view of a projection in a groove according to an example.

Also by way of example, as best shown in the inverted view of FIG. 4B, the groove 16 can be formed to have a depth that changes along any amount of the length of the groove 16, for example in a ramp-like or tapered fashion, to vary the resistance felt by the user when opening the compact device. It should be appreciated that the width of the groove 16 can change along the length of the groove, for example by narrowing, in a similar manner as described with respect to the depth. For example, the depth and/or width of the groove 16 can be larger at the area where the projection 12 is located when the base 10 and center section 20 are closed. At this position, it should be appreciated that the projection 12 may or may not have contact with side walls and/or a bottom portion of the groove 16. As the sections are pivoted, the depth and/or width can decrease along the length of the groove 16 until the end of the groove 16. For example, as shown in FIG. 4B, the bottom surface 21 of the groove 16 is formed in a ramp-like fashion to change the depth of the groove 16. When the sections are completely rotated, the projection 12 is at the end of the groove 16 and the base 10 and center section 16 are at their largest rotation with respect to each other. In this example as the base 10 and center section 20 are rotated open, the depth and/or width is made smaller to increase the resistance between the projection 12 and groove 16 as the projection 12 moves from its starting position to its ending position. Accordingly, the resistance felt by the user during opening can progressively increase during opening.

In an example, at the end position for the projection 12 in the groove 16, the groove 16 is formed with an abutment to prevent the projection 12 from sliding any further and thus, the center section 20 will not rotate beyond the opening rotational limit.

Conversely in this example, as the user closes the compact device and the projection moves to a closed position, the increase in depth and/or width of the groove 16 and thus decreasing resistance between the projection 12 and groove 16, will reduce the resistance felt by the user and force required to be applied by the user to close the device. Similarly, if the user stops rotation of the device while the projection 12 and groove 16 are in contact and providing resistance, then the sections or housing being rotated will not continue rotating with respect to each other due to forces such as gravity, and the sections can remain in their current positions.

According to this example, the changing of the depth of the groove 16 will provide a secure and controlled swiveling of the sections with respect to each other. Further, the projection sliding in the groove can provide a secure non-loose feeling to the user during opening and closing of the compact device. It is to be understood that a secure, non-loose feel can also be provided by resistance between the projection and groove with a constant or substantially constant depth and width groove along any length of the groove, while the provision of a varying depth and/or width groove along any length of the groove provides a further improvement. It is also to be understood that, while the groove is illustrated as provided on the center section and the projection on the base, their positions can be reversed. Similarly, the positions of the projection 25 and recess 7 could also be reversed.

As a further example, the groove 16 can be formed in only a portion of the bottom area of the center section 20. For example, the groove 16 can be formed to have a depth and/or width to receive the projection 12 when the base 10 and center section 20 are in the closed position. As the base 10 and center section 20 are rotated open, the depth and/or width of the groove 16 can decrease until a groove is no longer formed in the bottom surface of the center section 20. At this time, as the user continues rotating the base 10 and center section 20 with respect to each other, the projection 12 will slidingly engage the bottom surface of the center section 20 outside of the grooved area. That is, in this example, once the projection 12 has exited the groove 16, the amount of contact between the projection 12 and bottom surface will remain substantially constant due to the constant depth of the bottom surface and therefore a substantially constant resistance will be felt by the user.

As a further example, the position of the groove 16 with respect to a location of the pin 40 and thus, pivot axis 3, can be changed in order to vary the resistance between the projection 12 and a surface of the groove 16. That is, a distance between the pin 40 and a side wall of the groove 16 closest to the pin 40, can increase along the length of the groove 16, for example from the right end of the groove 16 to the left end as viewed in FIG. 4A. Accordingly, as the projection 12 moves in the groove 16 from a position when the sections are in the closed position to a position when the sections are in the opened position, the contact between the projection 12 and the inner side wall of the groove 16 will increase and therefore the resistance felt by the user will increase. It should be appreciated that the projection 12 could contact the side wall of the groove 16 located further from the pivot pin 40 to vary the resistance felt by the user.

As best shown in FIGS. 3A, 3B and 4A, the groove 16 is formed at a location apart from the pin receiving portion 25. Similarly, as shown in FIG. 3B, the projection 12 is positioned away from the location of the pin 40 and aperture 7 so as to match the position of the groove 16. Therefore, according to examples of the invention, the groove 16 and projection 12 are located apart from the features of the pivoting mechanism and thus, are not formed as one unit. Accordingly, this allows the thickness of the side walls of the base 10 and center section 20 in at least the area of the pivot pin 40, to be made smaller. Having a smaller side wall thickness allows for a larger interior hollow portion of the pivoting sections which will allow more product to be stored, a larger mirror to be provided, a larger cosmetic pad to be provided, and the like.

It should be appreciated that the thickness of the side walls could vary around the circumference of the compact device. For example, one or more embodiments could provide the smaller wall thickness in the area of the pivoting mechanism with the area of the walls around the remainder of the section to be of a different thickness depending on design and aesthetic considerations. The area having the thinner thickness can be made of the same, similar, or different material than the remaining portion of the side walls. It should be appreciated that an example of the invention could provide the thinner side wall area in areas other than around the pivoting mechanism to allow flexible design considering consumer desires, feels and gripping considerations. Additionally, providing a thinner side wall area around one or more portions of the base 10, center section 20, and/or cover 30 allows for compensation for tolerance variations that can arise due to production molds and various other factors and can help maintain contact between the surfaces in the opened or closed positions.

According to an example shown in FIG. 4A, an indentation 27 or similar type structure can be formed in the bottom surface of the center section 20 to prevent the projection 12 from sliding any further and thus, the center section 20 will not rotate beyond the opening rotational limit. For example, when the base 10 and center section 20 are pivoted in a right to left direction as viewed in FIG. 4A to full rotation, the projection 12 will slide from its contact with the bottom surface, which has created resistance to the user, to sliding into the indentation 27, which is a position of reduced resistance. Accordingly, the base 10 and center section 20 will be in a locked position with respect to each other and the compact device will be securely set in the opened position. Further, the user will be able to feel when the device is in the open position because of the change in resistance felt by contact between the projection 12 and bottom surface compared to the projection 12 sliding into the indentation 27. For example, the indentation 27 can be a substantially circular area. It should be appreciated that the indentation 27 can be any desirable shape and can be formed at the beginning area of the groove 16 in addition to or instead of at an end portion of the groove 16. Further for example, the indentation 27 can be formed as an area larger or smaller than the portion of the groove 16 adjacent the indentation 27, which will allow the projection 12 to slide therein and allow the user to feel the change in resistance.

As a further example, bumps 28 can be provided on one or more side walls and/or on a bottom surface of the groove 16. The bumps 28 can be provided at a location before the end portion of the groove 16, for example, at a location just before the indentation 27. Having bumps 28 in this location will generate an audible click when the projection 12 is moved past the bumps 28 and into the indentation 27 to alert the user that the compact device has been secured in an opened position. Similarly, the bumps can be provided on side and/or bottom surfaces near the beginning portion of the groove 16, for example, near the right side of the groove shown in FIG. 4A, to generate a noise to indicate to the user that the compact device is in the closed position. It should be appreciated that the bumps can have any desirable shape or size.

As discussed above, the abutment and indentation 27 can provide for a secure stopping position of the base 10 with respect to the center section 20. At this position, there is minimal overlap between the base 10 and center section 20 and these sections are in a position substantially adjacent to each other. In this way at the opening rotational limit, the stored cosmetic and/or other material can easily be removed and for example, the mirror 9 can be optimally utilized by the consumer without interference with other parts of the compact device.

Figure 5:
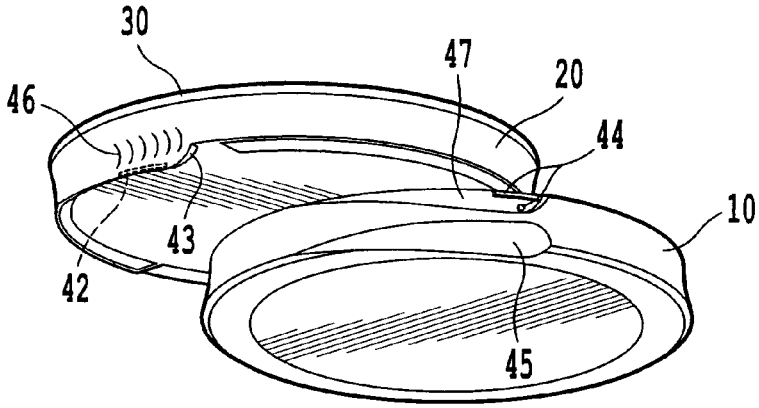
FIG. 5 is a side view of a compact device according to an example of the invention.

According to an example shown in FIGS. 5 and 6, a securing device 42 can be formed on an inside of a side surface of the center section 20. It should be appreciated that the securing device 42 can be formed on an outside side surface or in the side wall of the center section 20. Similarly, one or more ridges 44 can be provided on the base 10 that are configured to engage the securing device 42 of the center section to aid in securing the compact device in the closed position. A flange 43 of the side wall of the center section 20 is formed to substantially mate with a cut-out area 47 formed in the base section 10. As an example, the flange 43 can be formed to extend the length of the base section 10, for example, to extend to a position substantially coplanar with a bottom surface of the base section 10. In this example, the cut-out area 47 would be formed to dimensions to match the size of the flange 43. Accordingly, as the section 20 is rotated to the open position and the compact device is placed on a supporting surface, the flange 43 would be of sufficient size to extend down to the supporting surface and support the device in the open position.

According to an example, when the center section 20 is rotated to a closed position with respect to base 10, the securing device 42 will engage the ridges 44, and the flange 43 will mate with the cut-out area 47 to thereby secure the sections together and also prevent any further rotation of the two sections with respect to each other. Additionally, the engagement between the securing device 42 and ridges 44 can generate an audible noise to alert the user that the compact device has been secured together. It should be appreciated that the ridges 44 and protrusion 42 can have any desirable shape or size and the connection device between the center section 20 and base section 10 can be in the form of a clasp or snap or similar structure in order to facilitate the connection there between. Accordingly, when the base 10 and center section 20 are closed with respect to each other, the user will have to provide enough force to sufficiently engage the securing device 42 and ridges 44 to close the device.

An example further provides a base groove 45 formed in the base section 10 to allow a user to place part of the hand or fingers thereon. A user can apply a force to the base groove 45 while opening the compact device. Additionally, side wall protrusions 46 can be provided on the side wall of the center section 20 to further aid the user in gripping the device when opening. Therefore, when opening the device, the user can place one or more fingers in the base groove 45 and one or more fingers along the side wall protrusions 46 and apply a force in substantially opposite directions to overcome the contact provided between the securing device 42 and the ridges 44 in order to open the device. Accordingly, the compact device will not rotate in the opening direction by merely touching either of the base 10 or center section 20, and the cosmetic materials can be safely stored in the compact device. Further, the user can feel the closing rotational limit and the opening rotational limit of sections so that a stable and favorable feel of use can be obtained.

Figure 7:
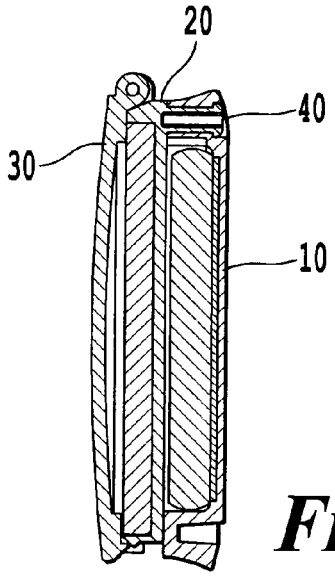
FIG. 7 is a cross-section of a compact according to an example of the invention.

FIG. 7 shows a cross sectional view of an embodiment with the base section 10 and center section 20 closed with respect to each other and the cover 30 closed. As shown in FIG. 7, the connection between the base 10 and center section 20 by way of the pin 40 is formed completely within the side walls of the two sections. The pivot axis between the cover 30 and center section 20 is shown similar to the pivot axis shown in FIGS. 1 and 2. However, it should be appreciated that the pivot axis could be formed to be flush with the side surface of the cover 30 and center section 20 as shown in FIG. 6.

Obviously, numerous modifications and variations of the present invention are possible in light of the above teachings. It is therefore to be understood that within the scope of the appended claims, the invention may be practiced otherwise than as specifically described herein.

The invention claimed is:

1. A device for containing a product, comprising:

a plurality of stacked sections pivotable with respect to each other about an axis; and a lid configured to cover one of the sections, wherein the sections are substantially aligned with each other when the device is in a closed position and when the sections are pivoted with respect to each other in a direction transverse to the axis to an opened position, the sections are not aligned with each other, wherein at least one section includes a projection which is received in a semicircular groove formed in an adjacent section, wherein at least one of a depth and a width of the groove gradually changes from a first end of the groove to a second end of the groove, wherein the depth of the groove changes along substantially an entire length of the semicircular groove to thereby increase a resistance created between the projection and the groove from approximately the first end having a first depth to approximately the second end having a shallower depth than the first end, and wherein the projection is moved the length of the semicircular groove from the first end when the sections are in the closed position to the second end when the sections are the opened position.

2. The device according to claim 1, wherein the projection is formed on an upper surface of a first section, and the groove is formed in a bottom surface of a second section.

3. The device according to claim 2, wherein when the first and second sections are in a closed position with respect to each other, the projection is received into a beginning portion of the groove and the projection has little or no contact with an inside surface of the groove.

4. The device according to claim 3, wherein the beginning portion of the groove is formed as the deepest portion of the groove.

5. The device according to claim 3, wherein the width of the groove gradually decreases along a length of the groove from the beginning portion to an ending portion to thereby increase a resistance created between the projection and the groove as the sections are pivoted to an opened position.

6. The device according to claim 4, wherein the projection is received within the groove from when the sections are in the closed position to when the sections are at a complete rotation with respect to each other.

7. The device according to claim 6, wherein the groove extends in an arc shape from a beginning area that is substantially adjacent a side surface of the second section to an ending area substantially adjacent the side surface of the second section.

8. The device according to claim 7, wherein the second area of the groove is formed to have a depth to receive the projection to substantially secure the first and second sections in the opened position.

9. The device according to claim 2, wherein the groove extends in the curved shape from a beginning area substantially adjacent a side surface of the second section to an ending area not adjacent the side surface of the second section.

10. The device according to claim 9, wherein the projection is received within the groove from the beginning area to the ending area and after exiting the ending area of the groove, the projection contacts the bottom surface of the section until the first and second sections have been completely rotated with respect to each other.

11. The device according to claim 10, wherein the bottom surface of the second section includes an indentation configured to receive the projection when the first and second sections are completely rotated with respect to each other.

12. The device according to claim 11, wherein the indentation is formed to have a depth to receive the projection therein to prevent further rotation of the first and second sections with respect to each other.

13. The device according to claim 12, wherein one or more bumps are formed on at least one of a side wall and bottom surface of the groove near at least one of the beginning area and ending area of the groove to provide an audible noise when the projection moves past the one or more bumps.

14. The device according to claim 13, wherein the one or more bumps are formed at a position just before the indentation.

15. The device according to claim 1, wherein at least a portion of the lid includes a transparent area to allow the product contained therein to be seen by a consumer.

16. The device according to claim 1, wherein the product is a cosmetic product.

17. The device according to claim 1, wherein the device is formed to have a circular shape.

18. The device according to claim 17, wherein side surfaces of one or more of the plurality of sections are tapered.

19. The device according to claim 1, further comprising a latching device configured to secure the first and second section with respect to each other.

20. The device according to claim 19, wherein the latching device generates an audible noise when the first and second sections are placed in the closed position.

21. The device according to claim 1, wherein a side surface of one or more of the plurality of sections includes a gripping area for the user having one or more protrusions.

22. The device according to claim 1, wherein a base section is formed as a lowermost section and a second section formed above the base section is secured to the base section by a securing device formed in a mating area of the sections.

23. The device according to claim 22, wherein the securing device is formed from engagement between side wall surfaces of the base section and second section.

24. The device according to claim 22, wherein the mating area of the second section projects down to substantially a plane formed by a bottom surface of the base section to support the device in a substantially level position when the base section and second section are rotated to an opened position.

25. The device according to claim 1, wherein one or more of the plurality of sections have hollow interiors.

26. The device according to claim 23, wherein a protrusion is formed on an inside surface of the second section side wall and is configured to engage a protrusion engaging device formed on the base section side wall.

27. The device according to claim 26, wherein the protrusion engaging device is formed from two ridges that allow the second section wall protrusion to slide therebetween.

28. The device according to claim 25, wherein the hollow interiors are configured to contain one of a cosmetic product, a mirror, a cosmetic pad, and the like.

29. A device for containing a product, comprising:

a plurality of stacked sections; and a connection device extending between side walls of adjacent sections of the plurality of sections and forming an axis of rotation for the sections, wherein the connection device is contained within the side walls of the adjacent sections, wherein adjacent sections are substantially aligned when in a closed position with respect to each other, and are not aligned when the adjacent sections are rotated in a direction transverse to the axis, to an open position, wherein at least one section includes a projection which is received in a semicircular groove formed in an adjacent section, wherein at least one of a depth and a width of the groove gradually changes from a first end of the groove to a second end of the groove, wherein the depth of the groove decreases in a ramp-like fashion along substantially an entire length of the semicircular groove from a deeper portion at the first end to a shallower portion at the second end, to thereby increase a resistance created between the projection and the groove, and wherein the projection is moved along the entire length of the semicircular groove when the adjacent sections are pivoted with respect to each other from an opened position to a closed position.

30. The device according to claim 29, wherein the connection device is substantially in the shape of a tubular member or pin.

31. The device according to claim 30, wherein an area of the sides walls containing the connection device is thinner than an area of the remainder of the side walls.

32. The device according to claim 30, wherein the depth of the groove decreases in a substantially linear manner along at least part of a length of the groove.

33. The device according to claim 30, wherein a pin receiving portion of a first section is configured to be inserted into an aperture formed in an adjacent section to secure the sections together.

34. The device according to claim 33, wherein the pin is configured to be inserted into the pin receiving portion to expand side walls of the pin receiving portion and enhance the contact between the side walls of the pin receiving portion and an interior wall of the aperture.

35. The device according to claim 29, wherein the projection is formed in a bottom section and the groove is formed in a bottom surface of an adjacent upper section.

36. The device according to claim 35, wherein when the two adjacent sections are in the closed position with respect to each other, the projection is received into a deepest portion of the groove.

37. The device according to claim 36, wherein the projection moves in substantially an arc shape to substantially match the curved shape of the groove.

38. The device according to claim 36, wherein the width of the groove gradually decreases along a length of the groove from the beginning portion to an ending portion to thereby increase a resistance created between the projection and the groove as the sections are pivoted to an opened position.

39. The device according to claim 29, wherein one or more of the plurality of sections have hollow interiors.

40. The device according to claim 37, wherein the groove extends in an arc shape from a first area substantially adjacent a side surface of the upper section to a second area substantially adjacent the side surface of the upper section.

41. The device according to claim 40, wherein the arc shaped groove is configured to receive the projection is formed at a distance from the connection device.

42. The device according to claim 40, wherein three or more sections pivot with respect to each other about respective connection devices.

43. The device according to claim 42, further comprising:

a cover forming a lid over an uppermost section of the plurality of sections, wherein the lid has a transparent area allowing a consumer to view an interior of the section.

44. The device according to claim 43, wherein the cover pivots about a pivoting device contained within the side walls of the upper section.

45. The device according to claim 44, wherein when the cover is in a closed position, an outside portion of the pivoting device is substantially planar with a side surface of the uppermost section.

46. The device according to claim 29, wherein the product is a cosmetic product.

47. The device according to claim 39, wherein the hollow interiors are configured to contain one of a cosmetic product, a mirror, a cosmetic pad, and the like.

48. A device for containing a product, comprising:

a plurality of stacked sections pivotable with respect to each other about an axis; and a lid attached to and configured to cover an uppermost section, the lid configured to pivot about a lid axis different from the axis of the stacked sections, wherein the sections are substantially aligned with each other when the device is in a closed position and when the sections are pivoted with respect to each other in a direction transverse to the axis to an opened position, the sections are not aligned with each other, wherein at least one section includes a projection which is received in a semicircular groove formed in an adjacent section, wherein at least one of a depth and a width of the groove gradually changes from a first end of the groove to a second end of the groove, and wherein the depth of the groove changes along substantially an entire length of the semicircular groove from the first end having a first depth to the second end having a depth smaller than the first end, and wherein the projection slides within the entire length of the semicircular groove from the first end when the sections are in a closed position to the second end when the sections are pivoted to a fully opened position.

49. The device according to claim 48, wherein the lid axis is formed in a side wall of the uppermost section and does not project from a periphery of the side wall of the uppermost section.

50. The device according to claim 49, wherein the lid axis is formed through a side wall of the uppermost section and a side wall of the lid.

51. The device according to claim 50, wherein when the uppermost section is pivoted with respect to an adjacent section, and the lid is in an opened position, the axis of the stacked sections and the lid axis are offset by approximately 90 degrees.

52. The device according to claim 51, wherein the lid is configured to rotate 90 degrees with respect to the uppermost section, to the opened position.

53. The device according to claim 51, wherein the lid is configured to rotate greater than 90 degrees with respect to the uppermost section, to the opened position.

54. The device according to claim 48, wherein the lid axis and portions of the side walls forming an area around the lid axis do not project from a periphery of the side walls when the lid is rotated between the closed and opened positions.

55. The device according to claim 48, wherein the projection is formed on an upper surface of a first section, and the groove is formed in a bottom surface of a second section.

56. The device according to claim 55, wherein when the first and second sections are in a closed position with respect to each other, the projection is received into a beginning portion of the groove.

57. The device according to claim 55, wherein the width of the groove gradually decreases along a length of the groove from the beginning portion to an ending portion to thereby increase a resistance created between the projection and the groove as the sections arc pivoted to an opened position.

58. The device according to claim 56, wherein when the projection is received in the beginning portion of the groove, the projection does not contact an inside surface of the groove.

59. A device for containing a product, comprising:

a plurality of stacked sections pivotable with respect to each other about an axis; and a lid configured to cover one of the sections, wherein at least one section includes a projection which is received in a groove formed in an adjacent section, wherein the sections are substantially aligned with each other when the device is in a closed position and when the sections are pivoted with respect to each other in a direction transverse to the axis to an opened position, the sections are not aligned with each other, wherein the projection and corresponding groove are configured such that an amount of mechanical resistance developed by the projection contacting the groove gradually changes along substantially an entire length of the groove when the projection is moved from a first area of the groove to a second area of the groove, and wherein the mechanical resistance increases between the projection and the groove along substantially the entire length of the groove as the projection is moved from the first end when the stacked sections are in the closed position to the second end when the sections arc in a fully opened position.

* * * * *